US010259106B2

(12) United States Patent
Chung

(10) Patent No.: US 10,259,106 B2
(45) **Date of Patent: *Apr. 16, 2019**

(54) SWITCH ASSEMBLY FOR A SELECTIVELY ONE-WAY WRENCH

(71) Applicant: Hui-Hsueh Chung, Taichung (TW)

(72) Inventor: Hui-Hsueh Chung, Taichung (TW)

( * ) Notice: Subject to any disclaimer, the term of this patent is extended or adjusted under 35 U.S.C. 154(b) by 146 days.

This patent is subject to a terminal disclaimer.

(21) Appl. No.: 15/482,758

(22) Filed: Apr. 8, 2017

(65) Prior Publication Data

US 2018/0290269 A1 Oct. 11, 2018

(51) Int. Cl.
*B25B 13/46* (2006.01)

(52) U.S. Cl.
CPC ..... *B25B 13/463* (2013.01)

(58) Field of Classification Search
CPC ..... B25B 13/463
USPC ..... 81/63.1
See application file for complete search history.

(56) References Cited

U.S. PATENT DOCUMENTS 2,201,827 A * 5/1940 Froeschl ..... B25B 13/463 192/43.2
6,857,339 B2 * 2/2005 Chen ..... B25B 13/463 192/43.1
7,082,859 B2 * 8/2006 Huang ..... B25B 13/463 81/62
7,299,720 B1 * 11/2007 Schultz ..... B25B 13/463 81/62
7,987,747 B2 * 8/2011 Ross ..... B25B 13/463 81/62
8,683,894 B1 * 4/2014 Chen ..... B25B 13/463 81/443

* cited by examiner

*Primary Examiner* — Hadi Shakeri
(74) *Attorney, Agent, or Firm* — Bruce Stone LLP; Joseph Bruce

(57) ABSTRACT

A selectively one-way wrench includes a head, a rotor, a pawl assembly, a switch, a connecting element and an auxiliary element. The pawl assembly includes two pawls. The switch is operable to disengage one of the pawls from the rotor and engage the other pawl with the rotor via the connecting element. The auxiliary element is used to tightly press one of the pawls against the rotor at a time.

8 Claims, 11 Drawing Sheets

SWITCH ASSEMBLY FOR A SELECTIVELY ONE-WAY WRENCH

BACKGROUND OF INVENTION

1. Field of Invention

The present invention relates to a selectively one-way wrench and, more particularly, to a switch assembly for a selectively one-way wrench.

2. Related Prior Art

As disclosed in U.S. Pat. No. 9,038,507 issued to the present applicant, a selectively one-way wrench includes a head 10, a gear 24, two pawls 20, a spring 107, a lever 70 and a disc 90. The gear 24 is inserted in the head 10. The pawls 20 are movably inserted in the head 10. The spring 107 included two ends connected to the pawls 20, respectively. Each of the pawls 20 includes a post 100. The disc 90 is pivotally inserted in the head 10. The disc 90 includes a cut-out 102 at an edge, thereby forming two hooks 106 on two sides of the cut-out 102. The lever 70 includes a post 92 pivotally inserted in the head 10. The disc 90 includes a bore 94 for receiving the post 92 of the lever 70 so that the disc 90 is rotatable by operating the lever 70. The lever 70 is pivoted between two positions, and so is the disc 90. As the first disc 90 is in the first position, the first hook 106 is engaged with the post 100 of the first pawl 20 to allow the head 10 to rotate the gear 24 via the first pawl 20 in a first sense of direction, but not in a second sense of direction. As the first disc 90 is in the second position, the second hook 106 is engaged with the post 100 of the second pawl 20 to allow the head 10 to rotate the gear 24 via the second pawl 20 in the second sense of direction, but not in the sense of direction. However, the engagement of each of the pawls 20 with the gear 24 is not tight enough so that the first or second pawl 20 could rattle on the gear 24 when the first or second pawl 20 is supposed to hold the gear 24, and this would wear the first or second pawl 20 against the gear 24.

The present invention is therefore intended to obviate or at least alleviate the problems encountered in prior art.

SUMMARY OF INVENTION

It is the primary objective of the present invention to provide a durable selectively one-way wrench.

To achieve the foregoing objective, the selectively one-way wrench includes a head, a rotor, a pawl assembly, a switch, a connecting element and an auxiliary element. The head includes three chambers, a groove and a cutout. The first chamber includes an open upper end and an open lower end. The second chamber is in communication with the first chamber. The third chamber is in communication with the second chamber. The third chamber includes an open upper end and a closed lower end made with a cavity. The groove is made in a wall of the third chamber. The cutout is made in a portion of the head that extends around the open upper end of the third chamber. The cutout is in communication with the third chamber. The rotor includes a toothed wheel, an upper shaft extending from the toothed wheel, and a lower shaft extending from the toothed wheel. The upper shaft is inserted in the open upper end of the first chamber. The lower shaft is inserted in the open lower end of the first chamber. The pawl assembly includes two pawls inserted in the second chamber and a spring compressed between the pawls. Each of the pawls includes a toothed face and a rod.

The connecting element includes a plate, a cam, a screw hole and two bores. The plate is inserted in the groove and formed two hooks. The cam is inserted in the third chamber and formed on a lower side of the plate. The cam includes a lobe between two contact faces. The screw hole and the bores are made in the connecting element. The auxiliary element extends around the cam, and includes two rectilinear portions, an arched intermediate portion between the rectilinear portions, and two arched terminal portions extending from the rectilinear portion, respectively. The switch includes a ring, a lever two bosses and two positioning units. The ring is inserted in the open upper end of the third chamber and formed with an aperture. The lever extends from the ring in a radial manner. The lever extends out of the third chamber through the cutout. The bosses extend into the bores of the connecting element from a lower face of the ring. Each of the positioning units is partially inserted in a corresponding one of the bores of the connecting element. A selected one of the positioning units is inserted in the cavity to keep the connecting element in a selected one of two positions relative to the head. The screw is inserted in the screw hole of the connecting element through the aperture of the ring to connect the switch to the connecting element. When the switch is in a selected one of two positions, a corresponding one of the hooks engages with the rod of a corresponding one of the pawls to disengage the toothed face of the corresponding pawl from the toothed wheel and pivot the auxiliary element. The spring pushes the pawl toward an end of the chamber so that a portion of a wall of the second chamber presses the pawl against the toothed wheel.

Other objectives, advantages and features of the present invention will be apparent from the following description referring to the attached drawings.

BRIEF DESCRIPTION OF DRAWINGS

The present invention will be described via detailed illustration of two embodiments referring to the drawings wherein.

DETAILED DESCRIPTION OF EMBODIMENTS

Figure 1:
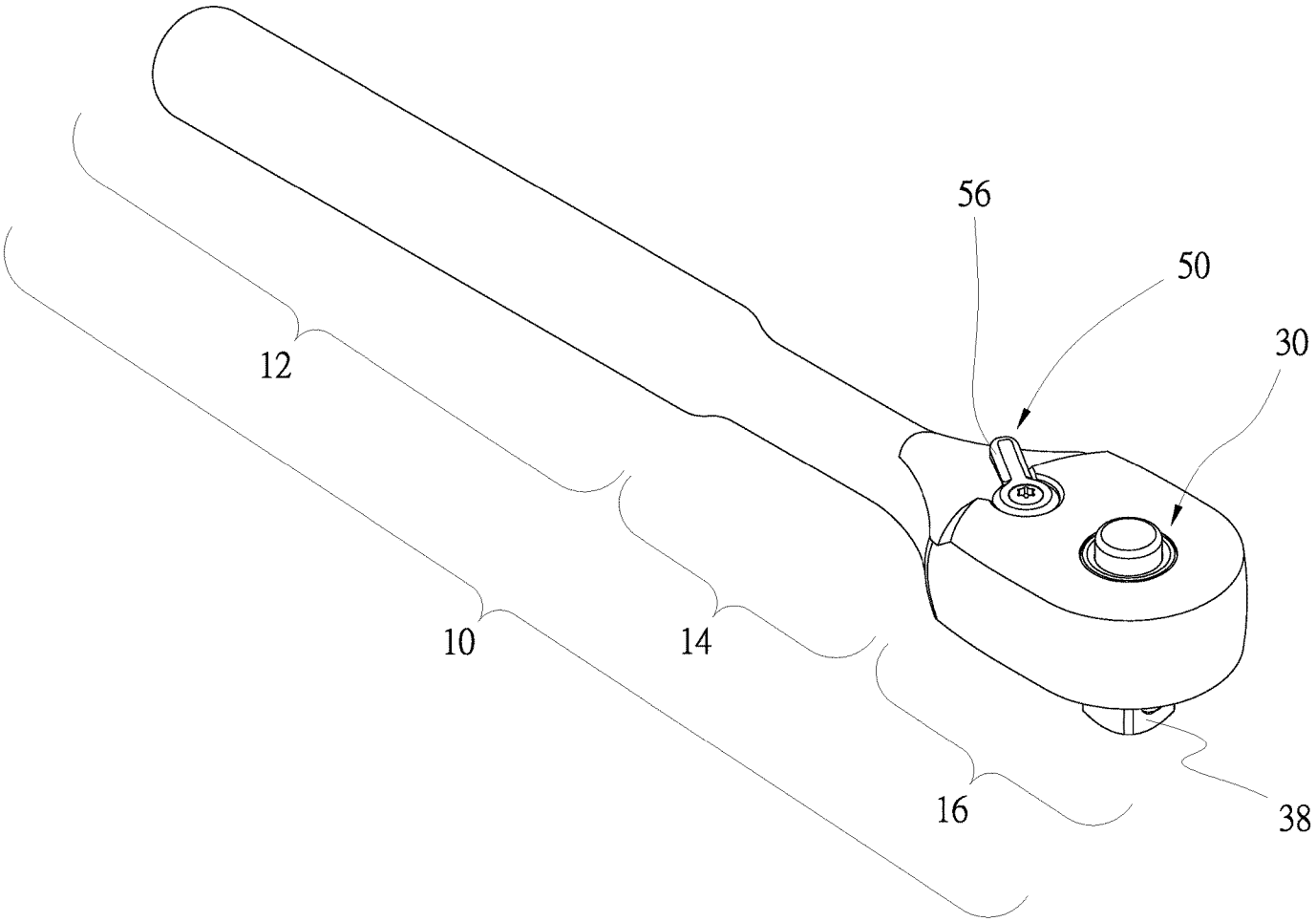
FIG. 1 is a perspective view of a selectively one-way wrench according to the first embodiment of the present invention.
Figure 2:
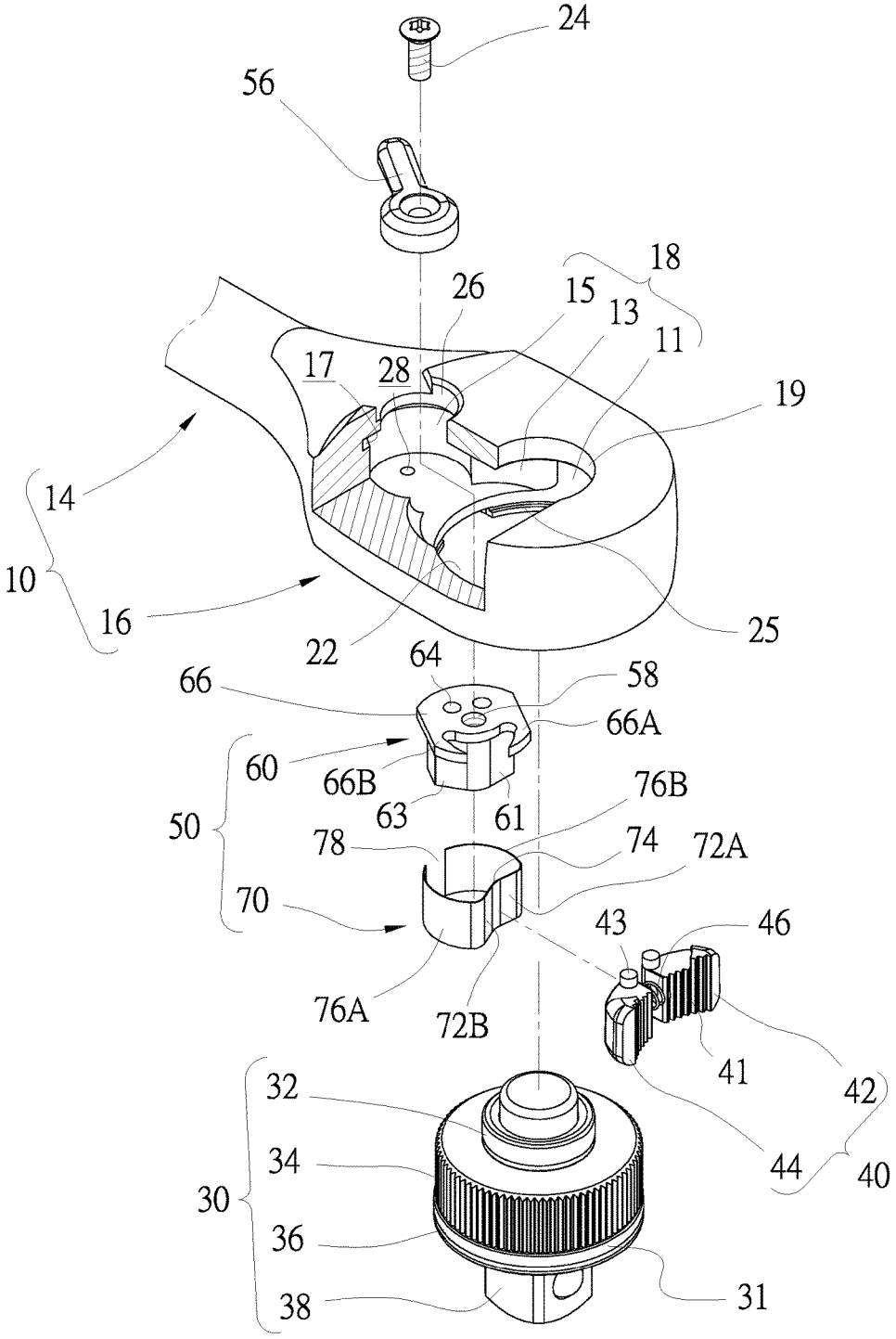
FIG. 2 is an exploded view of the selectively one-way wrench shown in FIG. 1.
Figure 3:
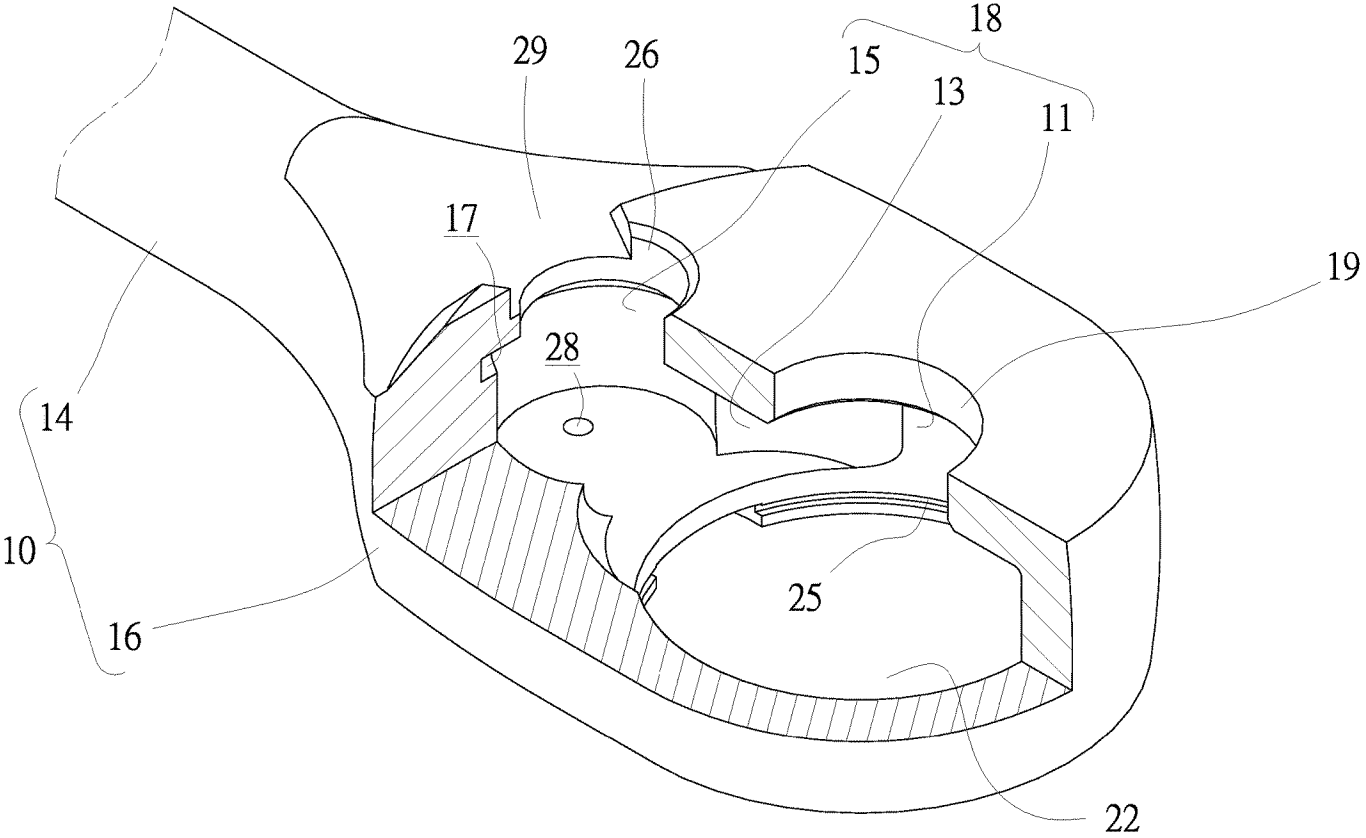
FIG. 3 is a cut-away view of a head of the selectively one-way wrench shown in FIG. 1.

Referring to FIGS. 1 through 3, a selectively one-way wrench 10 includes a grip 12, a shank 14, a head 16, a rotor 30, a pawl assembly 40 and a switch assembly 50 according to a first embodiment of the present invention. The grip 12, the shank 14 and the head 16 are made in one piece. The grip 12 is formed at an end of the shank 14. The head 16 is formed near another end of the shank 14. Thus, the grip 12 is operable to pivot the head 16 via the shank 14.

In another embodiment, the selectively one-way wrench 10 includes only the head 16, without using any grip or shank. Details for such an embodiment can be found in U.S. Pat. No. 9,038,507.

Referring to FIGS. 2 and 3, the head 16 includes a space 18 divided into three chambers 11, 13 and 15. The chambers 11 and 15 are substantially circular chambers. The chamber 13 is a substantially crescent chamber. The chamber 11 is in communication with the chamber 15 via the chamber 13.

The chamber 11 includes an open upper end 19 and an open lower end 22. The open upper end 19 is in an upper face of the head 16. The open lower end 22 is in a lower face of the head 16. The diameter of the open lower end 22 is larger than the diameter of the open upper end 19. A groove 25 is made in the wall of the chamber 11.

The chamber 15 includes an open upper end 26 and an open lower end made with a cavity 28. The open upper end 26 is in the upper face of the head 16. The diameter of the cavity 28 is smaller than that of the open upper end 26. A groove 17 is made in the wall of the chamber 15.

The head 16 further includes a cutout 29. The cutout 29 is made in a portion of the head 16 that extends around the open upper end 26 of the chamber 15. Hence, the cutout 29 is in communication with the open upper end 26.

The rotor 30 includes, from top to bottom, an upper shaft 32, a toothed wheel 34, a lower shaft 36 and a tongue 38. The diameter of the upper shaft 32 is smaller than that of the toothed wheel 34. The toothed wheel 34 includes a plurality of teeth formed on the periphery. The diameter of the lower shaft 36 is marginally larger than that of the toothed wheel 34. However, the diameter of the lower shaft 36 can be marginally smaller than that of the toothed wheel 34 in another embodiment. The lower shaft 36 includes a groove 31 made in the periphery. The tongue 38 extends from the center of the lower shaft 36. The tongue 38 includes a square periphery.

The pawl assembly 40 includes two pawls 42 and 44 and a spring 46. The pawls 42 and 44 and the spring 46 are inserted in the chamber 13. In a top view, the pawls 42 and 44 are mirror images of each other. Each of the pawls 42 and 44 includes a toothed face 41, a rod 43 and a recess 48. The toothed face 41 is formed on a substantially concave front face of each of the pawls 42 and 44. The rod 43 extends from an upper face of each of the pawls 42 and 44. The recess 48 is made in a lateral face of each of the pawls 42 and 44. The spring 46 includes two ends inserted in the recesses 48 of the pawls 42 and 44, respectively. The spring 46 tends to push the pawls 42 and 44 away from each other.

The switch assembly 50 includes two positioning units 51, a switch 56, a connecting element 60 and an auxiliary element 70.

Figure 4:
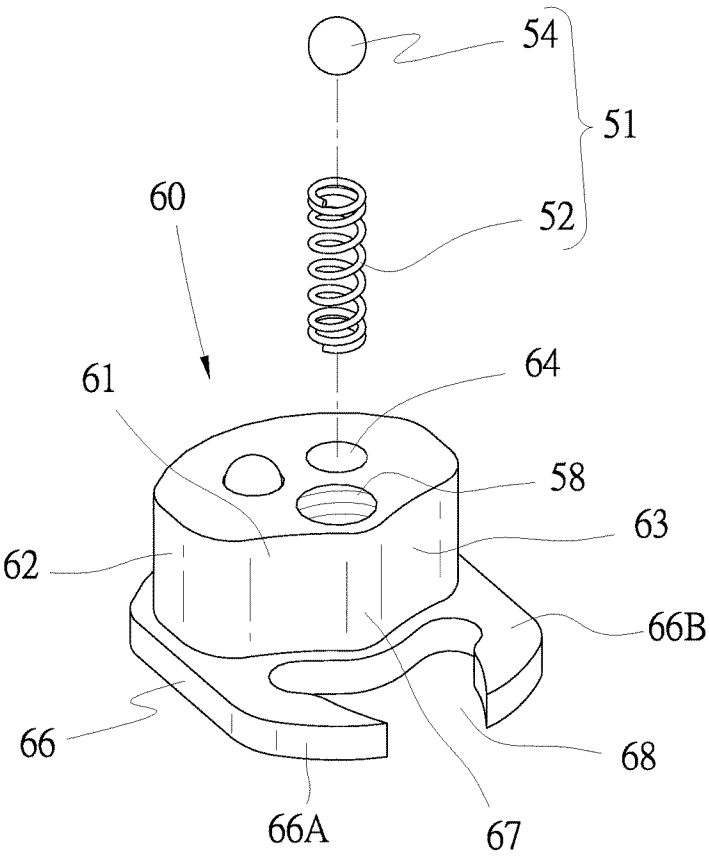
FIG. 4 is a perspective view of a connecting element of the selectively one-way wrench shown in FIG. 1.

Referring to FIG. 4, in which the connecting element 60 is positioned upside down, the connecting element 60 includes a plate 66, a cam 62, two bores 64 and a screw hole 58. The plate 66 is made with a cutout 68, thereby forming two hooks 66A and 66B on two opposite sides of the cutout 68.

The cam 62 extends from a lower face of the plate 66. The cam 62 includes a lobe 67 formed between two contact faces 61 and 63.

The screw hole 58 and the bores 64 extend throughout the connecting element 60. That is, each of the screw hole 58 and the bores 64 includes an open upper end in an upper face of the plate 66 and the cam 62 and an open lower end in a lower face of the cam 62.

Each of the positioning units 51 consists of a spring 52 and a ball 54. The spring 52 is adapted to bias the ball 54.

Figure 5:
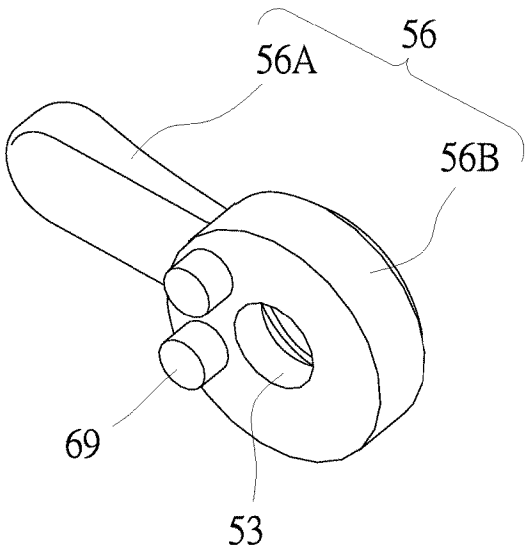
FIG. 5 is a perspective view of a switch of the selectively one-way wrench shown in FIG. 1.

Referring to FIG. 5, the switch 56 includes an aperture 53, a lever 56A, a ring 56B and two bosses 69. The lever 56A extends from the ring 56B in a radial direction. The aperture 53 is made in the ring 56B. The aperture 53 is preferably a countersink hole. The bosses 69 extend from a lower face of the ring 56B.

The auxiliary element 70 includes two rectilinear portions 72A and 72B, an arched intermediate portion 74 and two arched terminal portions 76A and 76B. The arched intermediate portion 74 extends between the rectilinear portions 72A and 72B. The arched terminal portion 76A extends from the rectilinear portion 72A while the arched terminal portion 76B extends from the rectilinear portion 72B. There is gap 78 between the free ends of the arched terminal portions 76A and 76B.

The ring 56B is located on the plate 66, with the bosses 69 inserted in the open upper ends of the bores 64. A screw 24 is inserted in the screw hole 58 through the aperture 53. Thus, the switch 56 is connected to the connecting element 60 so that the former is operable to pivot the latter.

Each of the positioning units 51 is inserted in a corresponding one of the bores 64, with each of the balls 54 exposed to the exterior of the corresponding bore 64 through the open lower end.

The auxiliary element 70 is located around the cam 62.

Figure 6:
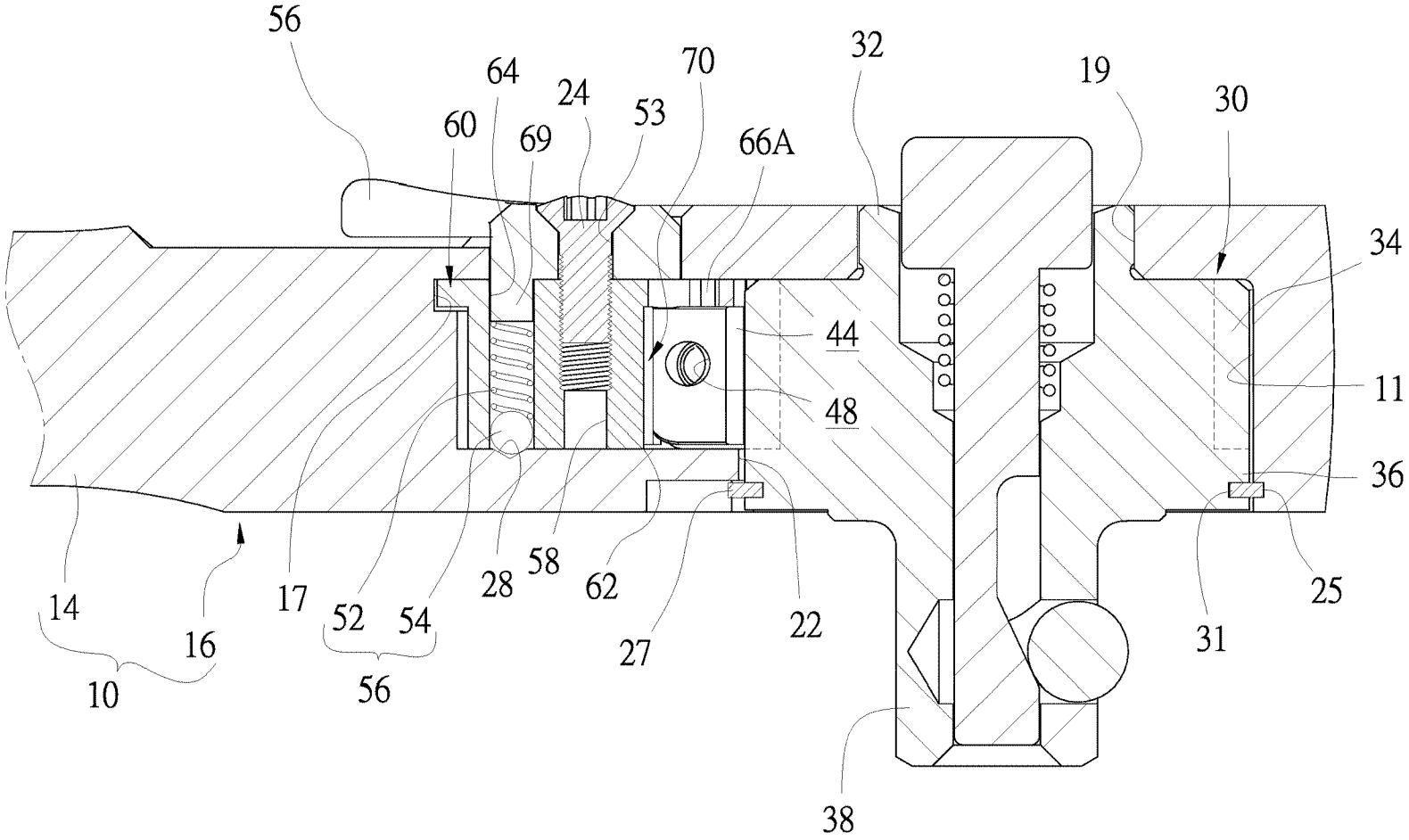
FIG. 6 is an enlarged, partial and cross-sectional view of the selectively one-way wrench shown in FIG. 1.

Referring to FIGS. 2 and 6, the upper shaft 32 is inserted in the open upper end 19. The toothed wheel 34 and the lower shaft 36 are inserted in the chamber 11. The tongue 38 extends out of the chamber 11 via the open lower end 22. The groove 31 is aligned with the groove 25. A C-clip 27 includes an internal edge inserted in the groove 31 and an external edge inserted in the groove 25 to keep the rotor 30 connected to the head 16. The rotor 30 is rotatable relative to the head 16.

The pawl assembly 40 is inserted in the chamber 13. The toothed face 41 of a selected one of the pawls 42 and 44 is engaged with the toothed wheel 34.

The connecting element 60 is inserted in the chamber 15. A selected one of the balls 54 is inserted in the cavity 28 to keep the switch assembly 50 in a selected one of two positions relative to the head 16. A selected one of the rectilinear portions 72A and 72B is abutted against a corresponding one of the pawls 42 and 44. An edge of the plate 66 is inserted in the groove 17 to render the switch assembly 50 smoothly rotatable relative to the head 16. The ring 56B of the switch 56 is inserted in the open lower end 22. The lever 56A of the switch 56 extends from the open upper end 26 via the cutout 29.

Figure 7:
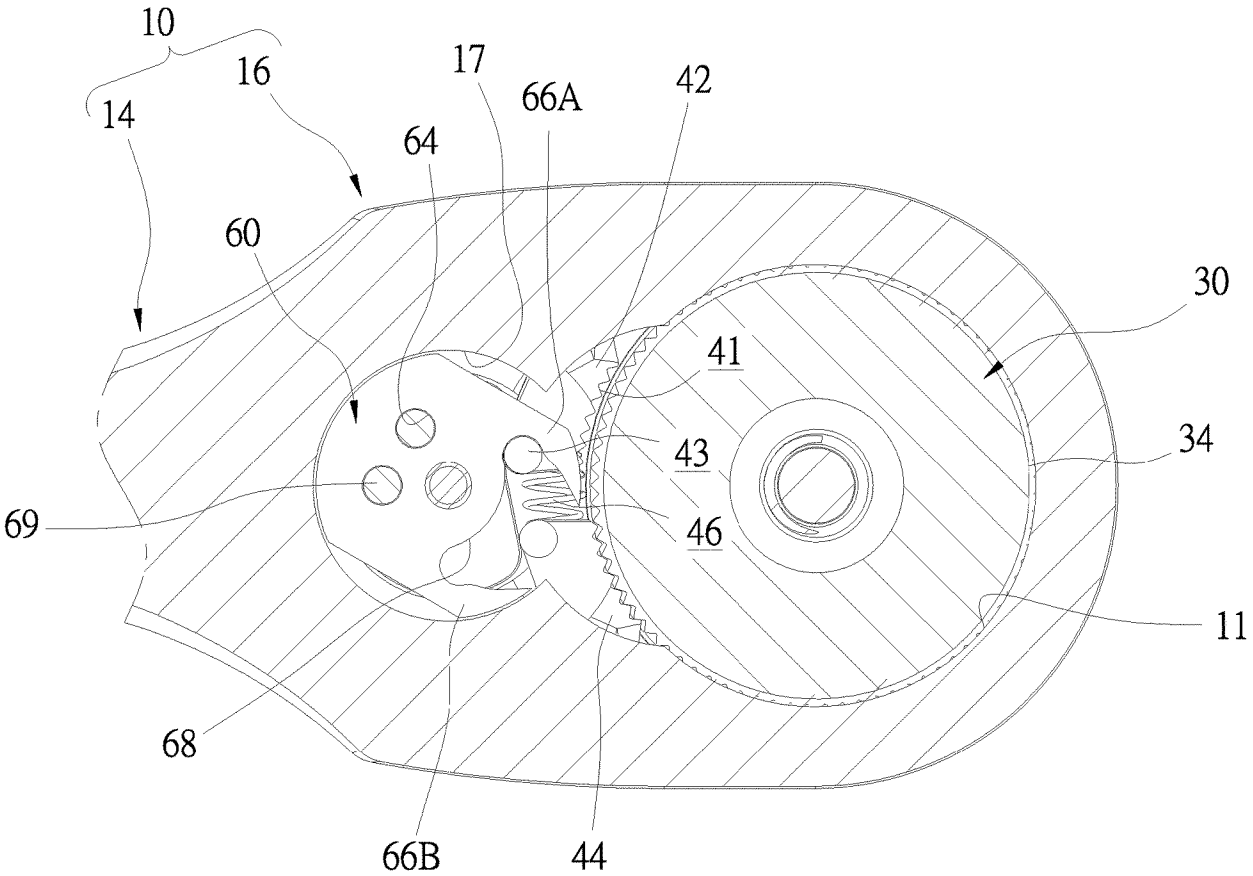
FIG. 7 is another enlarged, partial and cross-sectional view of the selectively one-way wrench shown in FIG. 1.
Figure 8:
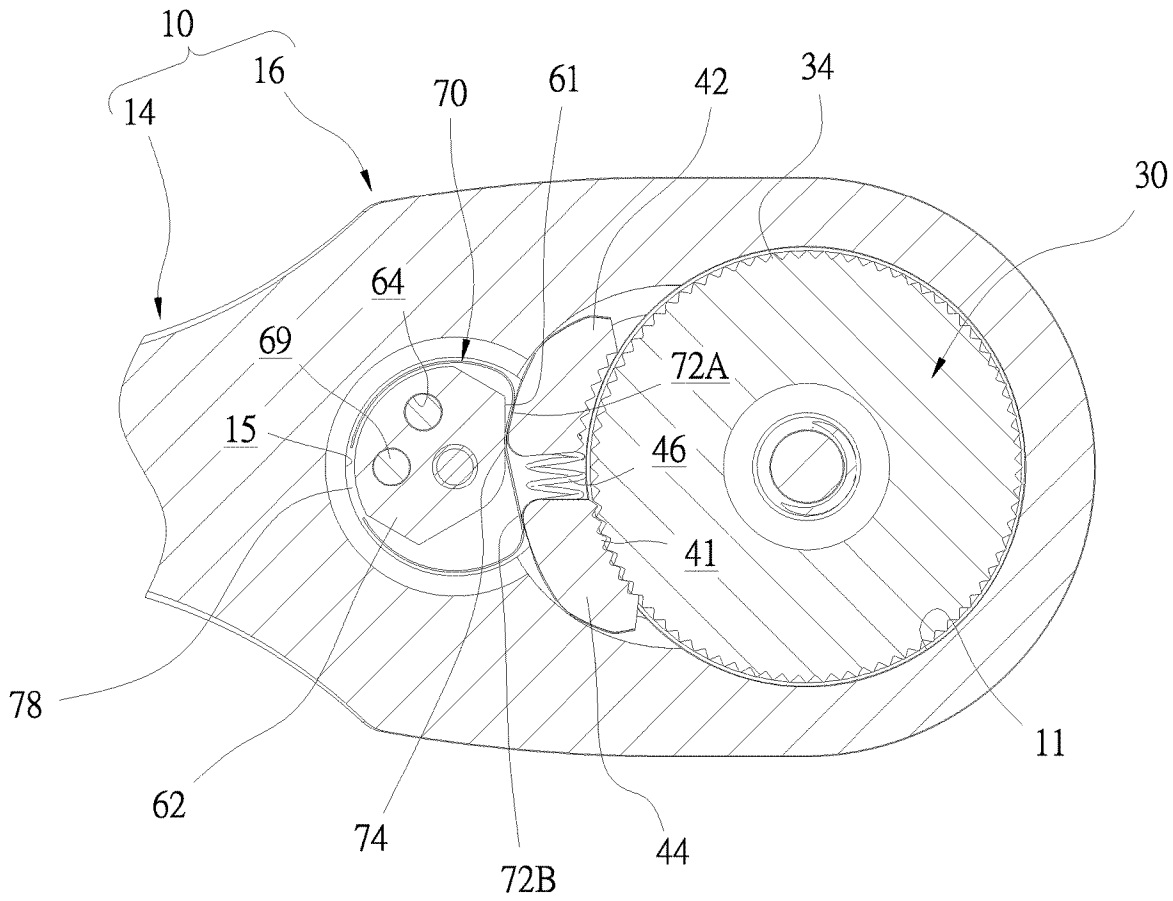
FIG. 8 is another enlarged, partial and cross-sectional view of the selectively one-way wrench pivoted in a sense of direction opposite to that is shown in FIG. 7.

Referring to FIGS. 7 and 8, the hook 66A of the connecting element 60 hooks the rod 43 of the pawl 42 to disengage the toothed face 41 of the pawl 42 from the toothed wheel 34. The pawl 42 presses the rectilinear portion 72A of the auxiliary element 70 and the contact face 61 of the cam 62 presses the arched intermediate portion 74 of the auxiliary element 70. Thus, the auxiliary element 70 is pivoted, and an angle between the rectilinear portions 72A and 72B is enlarged, i.e., the auxiliary element 70 is loaded. Accordingly, the rectilinear portion 72B of the auxiliary element 70 presses the pawl 44 against the toothed wheel 34. Now, the spring 46 pushes the pawl 44 toward an end of the chamber 13 so that a first portion of the wall of the chamber 13 presses the pawl 44 against the toothed wheel 34. That is, the rectilinear portion 72B of the auxiliary element 70 presses the pawl 44 against the toothed wheel 34 near an end while the portion of the wall of the chamber 13 presses the pawl 44 against the toothed wheel 34 near another end. Hence, the toothed face 41 of the pawl 44 firmly engages with the toothed wheel 34, and the head 16 effectively rotates the rotor 30 clockwise via the switch assembly 50.

Figure 9:
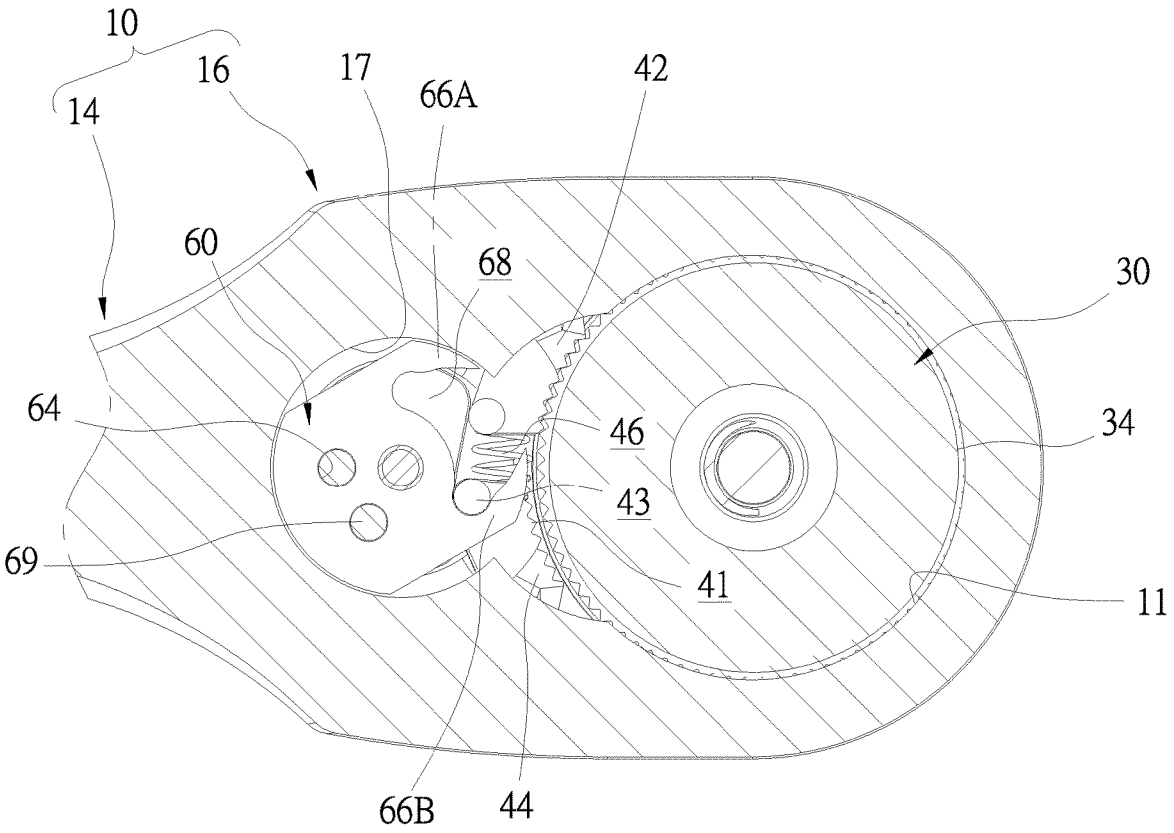
FIG. 9 is another enlarged, partial and cross-sectional view of the selectively one-way wrench in another mode than shown in FIG. 7.
Figure 10:
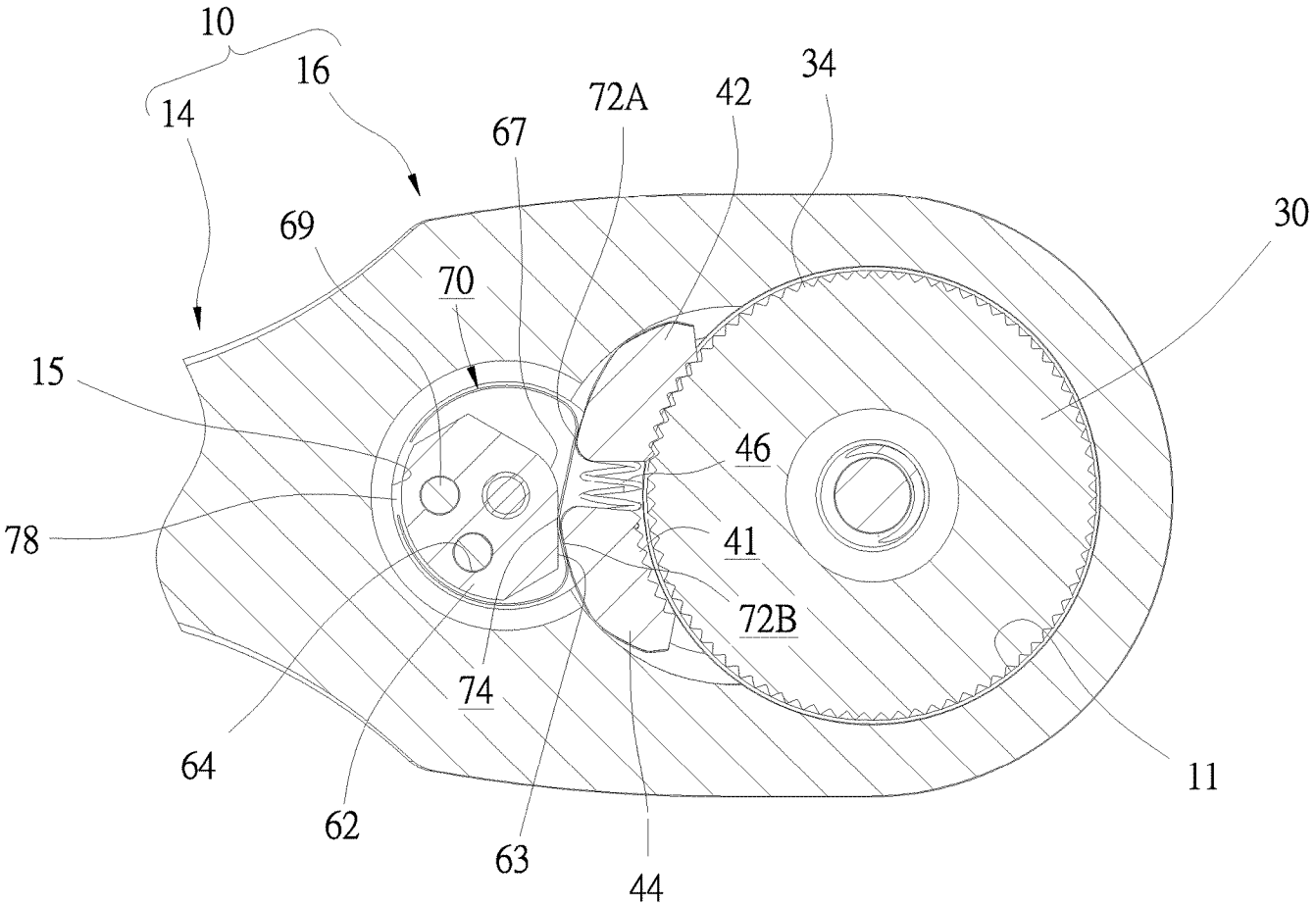
FIG. 10 is another enlarged, partial and cross-sectional view of the selectively one-way wrench pivoted in a sense of direction opposite to that is shown in FIG. 7.

Referring to FIGS. 9 and 10, the hook 66B of the connecting element 60 hooks the rod 43 of the pawl 44 to disengage the toothed face 41 of the pawl 44 from the toothed wheel 34. The pawl 44 presses the rectilinear portion 72B of the auxiliary element 70 and the contact face 63 of the cam 62 presses the rectilinear portion 72B of the auxiliary element 70. Thus, the auxiliary element 70 is pivoted, and an angle between the rectilinear portions 72A and 72B is enlarged, i.e., the auxiliary element 70 is loaded. Accordingly, the rectilinear portion 72A of the auxiliary element 70 presses the pawl 44 against the toothed wheel 34. Now, the spring 46 pushes the pawl 42 toward another end of the chamber 13 so that a second portion of the wall of the chamber 13 presses the pawl 42 against the toothed wheel 34. That is, the rectilinear portion 72A of the auxiliary element 70 presses the pawl 42 against the toothed wheel 34 near an end while the second portion of the wall of the chamber 13 presses the pawl 42 against the toothed wheel 34 near another end. Hence, the toothed face 41 of the pawl 42 firmly engages with the toothed wheel 34, and the head 16 effectively rotates the rotor 30 counterclockwise via the switch assembly 50.

Figure 11:
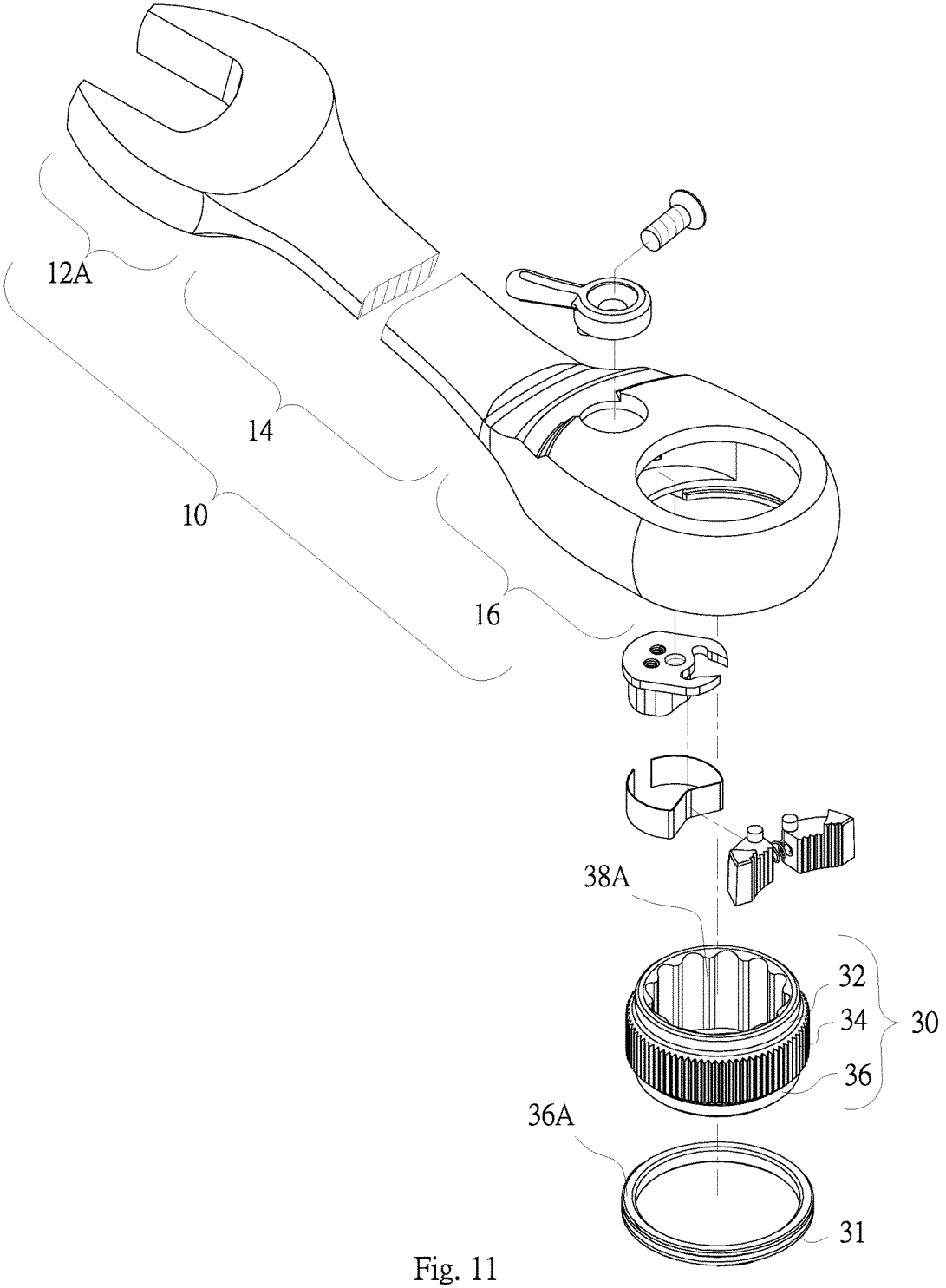
FIG. 11 is a perspective view of a selectively one-way wrench according to the second embodiment of the present invention.
Figure 12:
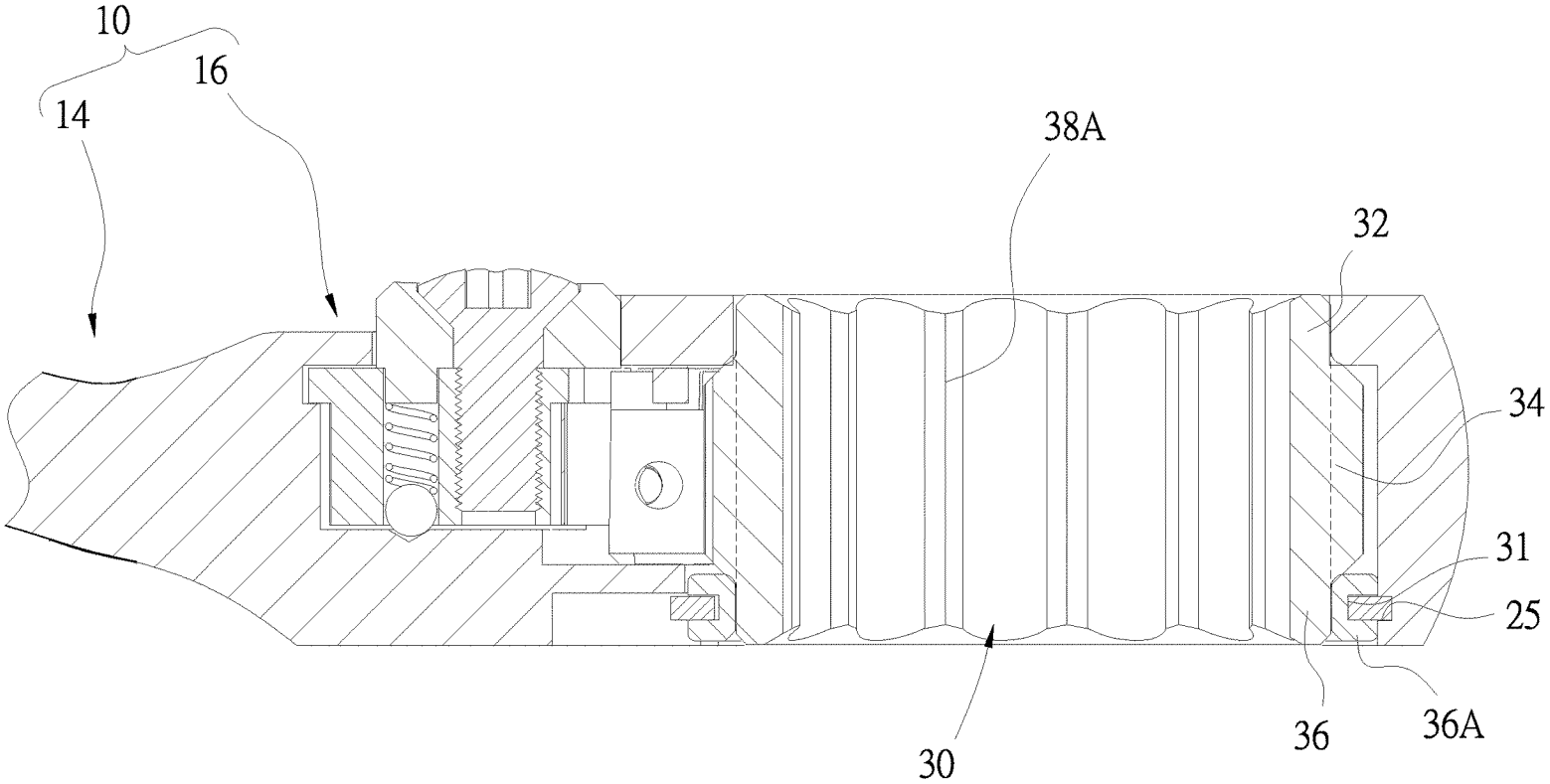
FIG. 12 is an enlarged, partial and cross-sectional view of the selectively one-way wrench shown in FIG. 11.

Referring to FIGS. 11 and 12, there is a selectively one-way wrench 10 according to a second embodiment of the present invention. The second embodiment is identical to the first embodiment except for several features. Firstly, an open end 12A is formed at an end of the shank 14 instead of the grip 12. Secondly, the rotor 30 includes a recess 38A instead of the tongue 38. The recess 38A axially extends throughout the upper shaft 32, the toothed wheel 34 and the lower shaft 36. Thirdly, there is an additional restraining ring 36A. The restraining ring 36A is located around the lower shaft 36 and against a shoulder (not numbered) formed between the lower shaft 36 and the toothed wheel 34. Accordingly, the groove 31 is made in the restraining ring 36A instead of in the lower shaft 36. The internal edge of the C-clip 27 is inserted in the groove 31 and the external edge of the C-clip 27 is inserted in the groove 25 to keep the rotor 30 connected to the head 16.

The present invention has been described via the illustration of the embodiments. Those skilled in the art can derive variations from the embodiments without departing from the scope of the present invention. Therefore, the embodiments shall not limit the scope of the present invention defined in the claims.

The invention claimed is:

1. A selectively one-way wrench comprising:

a head comprising:

a first chamber comprising an open upper end and an open lower end;

a second chamber in communication with the first chamber;

a third chamber in communication with the second chamber, wherein the third chamber comprises an open upper end and a closed lower end made with a cavity;

a groove made in a wall of the third chamber;

a cutout made in a portion of the head around the open upper end of the third chamber so that the cutout is in communication with the third chamber;

a rotor comprising:

a toothed wheel;

an upper shaft extending into the open upper end of the first chamber from the toothed wheel;

a lower shaft extending into the open lower end of the first chamber from the toothed wheel;

a pawl assembly comprising:

two pawls inserted in the second chamber, wherein each of the pawls comprises a toothed face and a rod; and a spring compressed between the pawls;

a connecting element comprising:

a plate comprising an edge inserted in the groove and two hooks extending from another edge;

a cam inserted in the third chamber, formed on a lower side of the plate, and made with two contact faces and a lobe between the contact faces;

a screw hole made in the connecting element; and two bores extending throughout the connecting element;

an auxiliary element extending around the cam and comprising:

two rectilinear portions;

an arched intermediate portion between the rectilinear portions;

two arched terminal portions extending from the rectilinear portions, respectively;

a switch comprising:

a ring inserted in the open upper end of the third chamber and formed with an aperture;

a lever extending from the ring in a radial manner, wherein the lever extends out of the third chamber through the cutout;

two bosses extending into the bores of the connecting element from a lower face of the ring;

two positioning units, with each of the positioning units partially inserted in a corresponding one of the bores of the connecting element, wherein a selected one of the positioning units is partially inserted in the cavity to keep the connecting element in a selected one of two positions relative to the head; and a screw inserted in the screw hole of the connecting element through the aperture of the ring to connect the switch to the connecting element;

wherein when the switch is in a selected one of two positions, a corresponding one of the hooks hooks the rod of a corresponding one of the pawls to disengage the toothed face of the corresponding pawl from the toothed wheel and hence pivot the auxiliary element, wherein the spring pushes the pawl toward an end of the chamber so that a portion of a wall of the second chamber presses the pawl against the toothed wheel.

2. The selectively one-way wrench according to claim 1, wherein when the switch is in the selected position, the selected pawl presses the corresponding rectilinear portion of the auxiliary element and a corresponding one of the contact faces of the cam presses the arched intermediate portion of the auxiliary element to enlarge an angle between the rectilinear portions of the auxiliary element to load the auxiliary element, thereby causing the other rectilinear portion of the auxiliary element to tightly press the pawl against the toothed wheel.

3. The selectively one-way wrench according to claim 1, further comprising a C-clip for clipping the lower shaft to the head.

4. The selectively one-way wrench according to claim 3, wherein the lower shaft comprises a groove for receiving an internal edge of the C-clip, and the head comprises a groove made in a wall of the first chamber and adapted for receiving an external edge of the C-clip.

5. The selectively one-way wrench according to claim 3, further comprising a restraining ring located around the lower shaft and abutted against a shoulder formed between the toothed wheel and the lower shaft, wherein the C-clip clips the restraining ring to the head.

6. The selectively one-way wrench according to claim 5, wherein the restraining ring comprises a groove for receiving an internal edge of the C-clip, and the head comprises a groove made in a wall of the first chamber and adapted for receiving an external edge of the C-clip.

7. The selectively one-way wrench according to claim 1, wherein the rotor further comprises a tongue coaxially extending from the lower shaft.

8. The selectively one-way wrench according to claim 1, wherein the rotor further comprises a recess axially extending throughout the upper shaft, the toothed wheel and the lower shaft.

* * * * *